US012385722B2

(12) United States Patent
Marvin

(10) Patent No.: US 12,385,722 B2
(45) Date of Patent: Aug. 12, 2025

(54) METHODS AND SYSTEMS ASSOCIATED WITH A SELF-DEFENSE DEVICE

(71) Applicant: Stunner Safety LLC, Houston, TX (US)

(72) Inventor: Sydney Grace Marvin, Houston, TX (US)

( * ) Notice: Subject to any disclaimer, the term of this patent is extended or adjusted under 35 U.S.C. 154(b) by 409 days.

(21) Appl. No.: 18/097,399

(22) Filed: Jan. 16, 2023

(65) Prior Publication Data

US 2023/0228537 A1 Jul. 20, 2023

Related U.S. Application Data

(60) Provisional application No. 63/361,713, filed on Jan. 18, 2022.

(51) Int. Cl.
*F41H 9/10* (2006.01)
*F41H 13/00* (2006.01)

(52) U.S. Cl.
CPC ..... *F41H 9/10* (2013.01); *F41H 13/0018* (2013.01); *F41H 13/0087* (2013.01)

(58) Field of Classification Search
CPC ..... F41H 9/10; F41H 13/0018
USPC ..... 42/1.08; 361/232
See application file for complete search history.

(56) References Cited

U.S. PATENT DOCUMENTS 4,982,645 A * 1/1991 Abboud ..... F41B 15/04 42/1.08
6,237,461 B1 * 5/2001 Poole ..... F41H 9/10 222/1
6,439,432 B1 * 8/2002 Park ..... H05C 1/00 222/113

* cited by examiner

*Primary Examiner* — Reginald S Tillman, Jr.
(74) *Attorney, Agent, or Firm* — Pierson IP, PLLC

(57) ABSTRACT

Self-defense devices with multiple tools that can be deployed for use in a defensive capacity.

14 Claims, 8 Drawing Sheets

METHODS AND SYSTEMS ASSOCIATED WITH A SELF-DEFENSE DEVICE

BACKGROUND INFORMATION

Field of the Disclosure

Examples of the present disclosure relate to a systems and methods associated self-defense devices. More specifically, embodiments are directed towards self defense devices with multiple tools that can be deployed for use in a defensive capacity.

Background

Every day, people are exposed to situations in which personal safety may be in jeopardy: while strolling on city sidewalks, walking to one's car at night, looking for one's car in a parking garage, etc. To protect themselves, people may carry self-defense devices.

Conventional self-defense may include pepper spray, taser, lights, knives, and other tools. However, these conventional devices do not allow user's to easily and effectively utilize each of these tools in a convenient manner.

Accordingly, needs exist for systems and methods for self-defense devices with multiple tools that can be effectively deployed and simultaneously utilized for use in a defensive capacity.

SUMMARY

Embodiments disclosed herein describe systems and methods for self defense devices with multiple tools. Embodiments may include a housing, inflammatory agent, first button, electroshock prongs, grip, first trigger, light sources, second button, and electronic components.

The housing may be a support structure that is configured to store and protect the components of the self defense device. The housing may be formed of plastics, metals, and/or any other rigid material. The housing may include a front surface, rear surface, bottom surface, top surface, and orifice.

The front surface of the housing may be a distal surface that is configured to be positioned away from the user when in use. The front surface may be substantially planer, and positioned in a plane that is substantially parallel to the rear surface. In embodiments, the electroshock prongs and light sources may be positioned on the front surface.

The rear surface of the housing may be a proximal surface that is configured to be positioned close to the user when in use. The rear surface may be substantially planer, and positioned in a plane that is substantially parallel to the front surface. In embodiments, the second button and electronic components may be positioned on the rear surface. In embodiments, a height associated with the rear surface may be longer than a height associated with a front surface.

The bottom surface of the housing may extend from the rear surface to the front surface. The bottom surface may be substantially planer, and positioned in a plane that is orthogonal to planes associated with the rear surface and the front surface.

The top surface of the housing may be a curved, tapered, or otherwise angled surface, which reduces a height of the housing from the rear surface to the front surface. In embodiments, the top surface may include an upwardly sloped portion, and a downwardly sloped portion.

The upwardly sloped portion may have a starting point at the rear surface and increases the height of the housing until an end point, which is a starting point of the downwardly sloped portion. The end point of the upwardly sloped portion may end directly after a face, nozzle, vent of the inflammatory agent.

A starting point of the downwardly sloped portion may start at the ending point of the upwardly sloped portion, and have an ending point at the front surface. In embodiments, the downwardly sloped portion may continuously decrease the height of the housing. A slope of the downwardly sloped portion may be variable, and have a larger angle or slope proximate to the front surface of the housing. The downward slope of the top portion of the housing may serve multiple purposes. Firstly, this slope may be configured to decrease a height and surface area of the front surface, which may allow a more concentration of force applied the front surface of the housing towards another object or person. Secondly, this slope may allow a nozzle of the inflammatory agent to be positioned behind and above the front surface, while not restricting a spray distribution of the inflammatory agent from the nozzle when the nozzle is positioned, angled, etc. parallel to the lower surface.

The inflammatory agent may be pepper spray or any other compound that is configured to cause eyes to close, cause a burning sensation, pain, etc. The inflammatory agent may be positioned within a removable canister, container, etc. that is configured to be inserted into the housing. The inflammatory agent may include a nozzle, jet, emitter, etc. that is configured to spray the inflammatory agent. The nozzle may be configured to be aligned with the upwardly sloped portion, behind the downwardly sloped portion of the housing, and above the top surface of the housing. The nozzle may be configured to spray the inflammatory agent towards the front surface in a space directly above the downwardly sloped portion of the housing.

The first button may be a mechanical button that is configured to allow the nozzle to spray the inflammatory agent responsive to being depressed. In embodiments, the first button may be configured to be activated responsive to receiving a force that is in parallel to planes associated with the rear surface and the front surface. In specific embodiments, the first button may be configured to be pressed by a thumb of a user.

The electroshock prongs may be positioned on the front surface of the housing above the light sources. The electroshock prongs may be configured to utilize an electric shock to incapacitate a target by either temporarily disrupting voluntary muscle control and/or through pain compliance. The electroshock prongs may be activated by contact an individual and the first trigger being pressed.

The grip may be positioned within the orifice of the housing, and may allow a user to hold the self defense tool. The grip may be contoured with a plurality of concave curves that are configured to receive user's fingers. In embodiments, the contoured curves associated with the different fingers. For instance, a curve associated with a pointer finger may be larger and be positioned in a different angle than the curves associated with the other fingers. This may curvature may assist a user when they are depressing the first trigger.

The first trigger may be embedded within the grip when pressed, and have a front surface that protrudes from the grip when not pressed. Responsive to the trigger being pressed the electroshock prongs may be activated. In embodiments, the trigger may be pressed by applying a user utilizing their fingers to create a force against the first trigger in a direction that is orthogonal to a force that is required to activate the first button. The first button and the first trigger may require forces being applied in different directions, and by different parts of the user's hand to allow for simultaneously use of multiple tools while reducing the chances of a user inadvertently using one of the tools.

The light source may be LED lights, or any other type of light, positioned on the front face of the housing. The light sources may be positioned below the electroshock prongs, which may allow the electroshock prongs to be aligned with the grip. In embodiments, the light source may be activated by a user pressing a second button positioned on the rear surface. The second button may be activated by the user applying forces from the rear surface towards the front surface, which may be an opposite direction necessary to press the first trigger. It may reduce the chances of the light sources and the electroshock prongs being inadvertently activated by requiring the light source and the electroshock prongs to be activated by applying forces in different directions.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
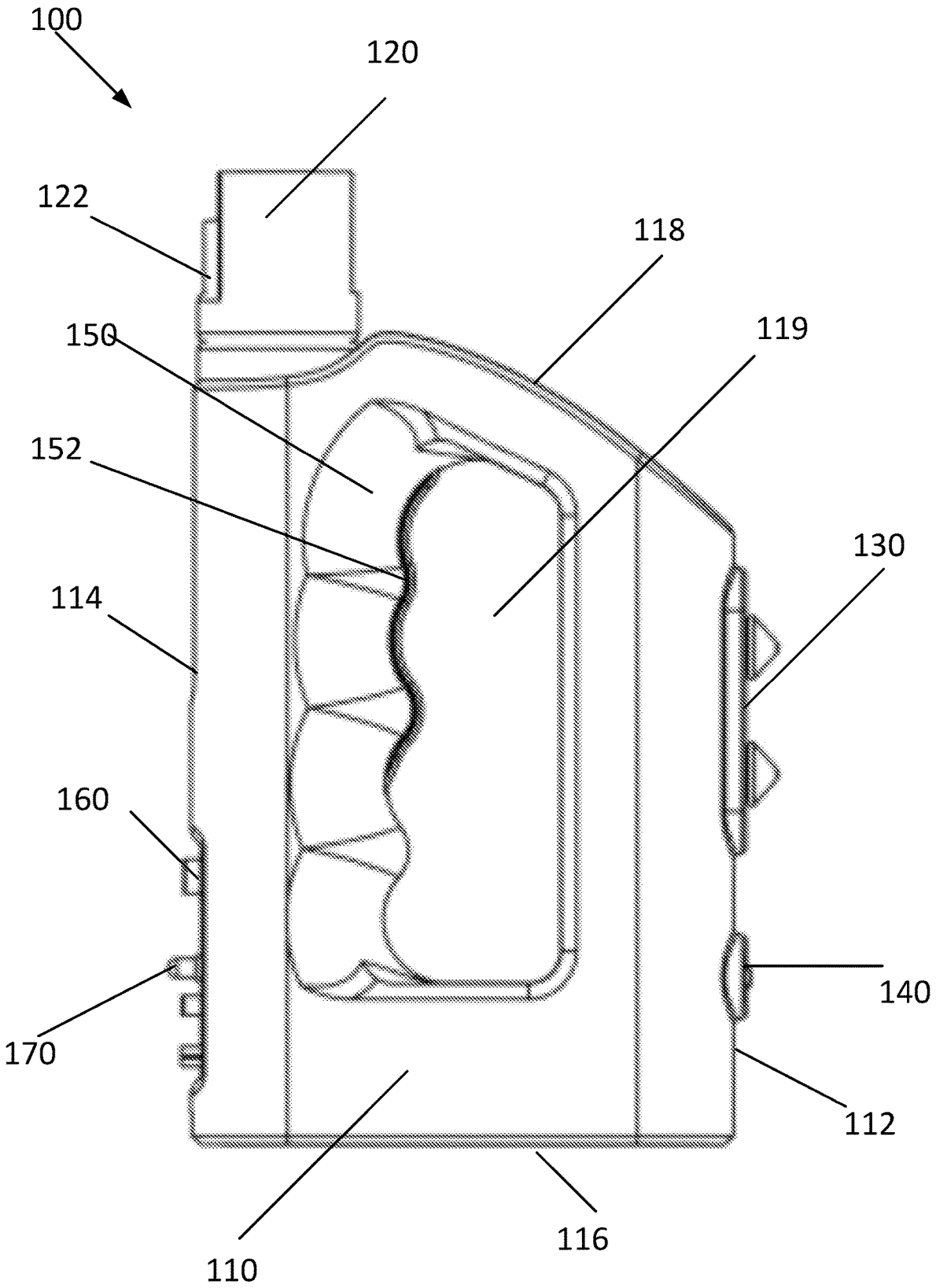
FIG. 1 depicts a first side view of a self-defense device, according to an embodiment.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments disclosed herein a self-defense device 100, according to an embodiment. Embodiments may include a housing 110, inflammatory agent 120, first button 122, electroshock prongs 130, grip 150, first trigger 152, light sources 140, second button 160, and electronic components 170.

Housing 110 may be a support structure that is configured to store and protect the components of the self-defense device 100. Housing 110 may be formed of plastics, metals, and/or any other rigid material. Housing 110 may include a front surface 112, rear surface 114, bottom surface 116, top surface 118, and orifice 119.

Front surface 112 may be a distal surface that is configured to be positioned away from the user when in use. Front surface 112 may be substantially planer, and positioned in a plane that is substantially parallel to rear surface 114. In embodiments, the electroshock prongs 130 and light sources 140 may be positioned on the front surface 112.

Rear surface 114 may be a proximal surface that is configured to be positioned close to the user when in use. Rear surface 114 may be substantially planer, and positioned in a plane that is substantially parallel to the front surface 112. In embodiments, the second button 160 and electronic components 170 may be positioned on rear surface 114. In embodiments, a height associated with rear surface 114 may be longer than a height associated with front surface 112.

Bottom surface 112 may extend from the rear surface to the front surface. The bottom surface may be substantially planer, and positioned in a plane that is orthogonal to planes associated with the rear surface 114 and the front surface 112.

Top surface 118 of the housing may be a curved, tapered, or otherwise angled surface, which reduces a height of the housing 110 from the rear surface 114 to the front surface 112. In embodiments, the top surface may include an upwardly sloped portion, an apex, and a downwardly sloped portion.

The upwardly sloped portion may have a starting point at the rear surface and increases the height of the housing until the apex, which is a starting point of the downwardly sloped portion. The apex of the upwardly sloped portion may end directly after a face, nozzle, vent of the inflammatory agent. This apex may be configured to create a maximum height of housing 110 at a location between front surface 112 and rear surface 114, which may protect inflammatory agent 120.

A starting point of the downwardly sloped portion may start at the apex, and have an ending point at the front surface 112. In embodiments, the downwardly sloped portion may continuously decrease the height of the housing 110. A slope of the downwardly sloped portion may be variable, and have a larger angle or slope proximate to the front surface of the housing. The downward slope of the top portion may serve multiple purposes. Firstly, this slope may be configured to decrease a height and surface area of the front surface 112, which may allow a more concentration of force applied the front surface 112 of the housing towards another object or person. Secondly, this slope may allow a nozzle of the inflammatory agent 120 to be positioned behind and above the front surface, while not restricting a spray distribution of the inflammatory agent from the nozzle when the nozzle is positioned, angled, etc. parallel to the bottom surface 116.

Inflammatory agent 120 may be pepper spray or any other compound that is configured to cause eyes to close, cause a burning sensation, pain, etc. Inflammatory agent 120 may be positioned within a removable canister, container, etc. that is configured to be removably inserted into the housing 110. Inflammatory agent 120 may include a nozzle, jet, emitter, etc. that is configured to spray the inflammatory agent. The nozzle may be configured to be aligned with the upwardly sloped portion, behind the downwardly sloped portion of the housing, and above the top surface 118. The nozzle may be configured to spray inflammatory agent 120 towards the front surface 112 in a space directly above the downwardly sloped portion of the housing 110.

First button 122 may be a mechanical button that is configured to allow the nozzle to spray the inflammatory agent 120 responsive to being depressed. In embodiments, first button 122 may be configured to be activated responsive to receiving a force that is in parallel to planes associated with the rear surface 114 and the front surface 112. In specific embodiments, first button 122 may be configured to be pressed by a thumb of a user, at a location that is vertically higher than that of the apex of top surface 118.

Electroshock prongs 130 may be positioned on the front surface 112 above the light sources 140. Electroshock prongs 130 may be configured to utilize an electric shock to incapacitate a target by either temporarily disrupting voluntary muscle control and/or through pain compliance. Electroshock prongs 130 may be activated by contact an individual and the first trigger 152 being pressed.

Light sources 140 may be positioned on front surface 112 below electroshock prongs 130. Light sources 140 may be configured to emit a light in front of housing 110, wherein light sources 140 may be activated and deactivated via second button 160.

Grip 150 may be positioned within the orifice 119 of the housing 110, and may allow a user to hold the self-defense tool. Grip 150 may be contoured with a plurality of concave curves that are configured to receive user's fingers. In embodiments, the contoured curves associated with the different fingers. For instance, a curve associated with a pointer finger may be larger and be positioned in a different angle than the curves associated with the other fingers. This may curvature may assist a user when they are depressing the first trigger 152. Grip 150 may also be configured to allow a user to transfer forces from their body to the front surface 112 of the self-defense device 100.

First trigger 152 may be embedded within the grip when pressed, and have a front surface that protrudes from the grip when not pressed. Responsive to first trigger 152 being pressed the electroshock prongs 130 may be activated. First trigger 152 may be aligned with electroshock prongs 130 along a lateral axis of self-defense device 100. This alignment may maximize a force created by a user pushing electroshock prongs 130 towards another person or object. In embodiments, first trigger 152 may be pressed by applying a user utilizing their fingers to create a force against the first trigger 152 in a direction that is orthogonal to a force that is required to activate the first button 122. The first button 122 and first trigger 152 may require forces being applied in different directions, and by different parts of the user's hand to allow for simultaneously use of multiple tools while reducing the chances of a user inadvertently using one of the tools.

Second button 160 may be activated by the user applying forces from the rear surface 114 towards front surface 112, which may be an opposite direction necessary to press the first trigger 152. It may reduce the chances of the light sources 140 and the electroshock prongs 132 being inadvertently activated by requiring the light sources 140 and the electroshock prongs 132 to be activated by applying forces in different directions.

Electronic components 170 may be positioned on rear surface 114. Electronic components 170 may include a charging port, power indicator, on-off switch, and other electrical components.

Figure 2:
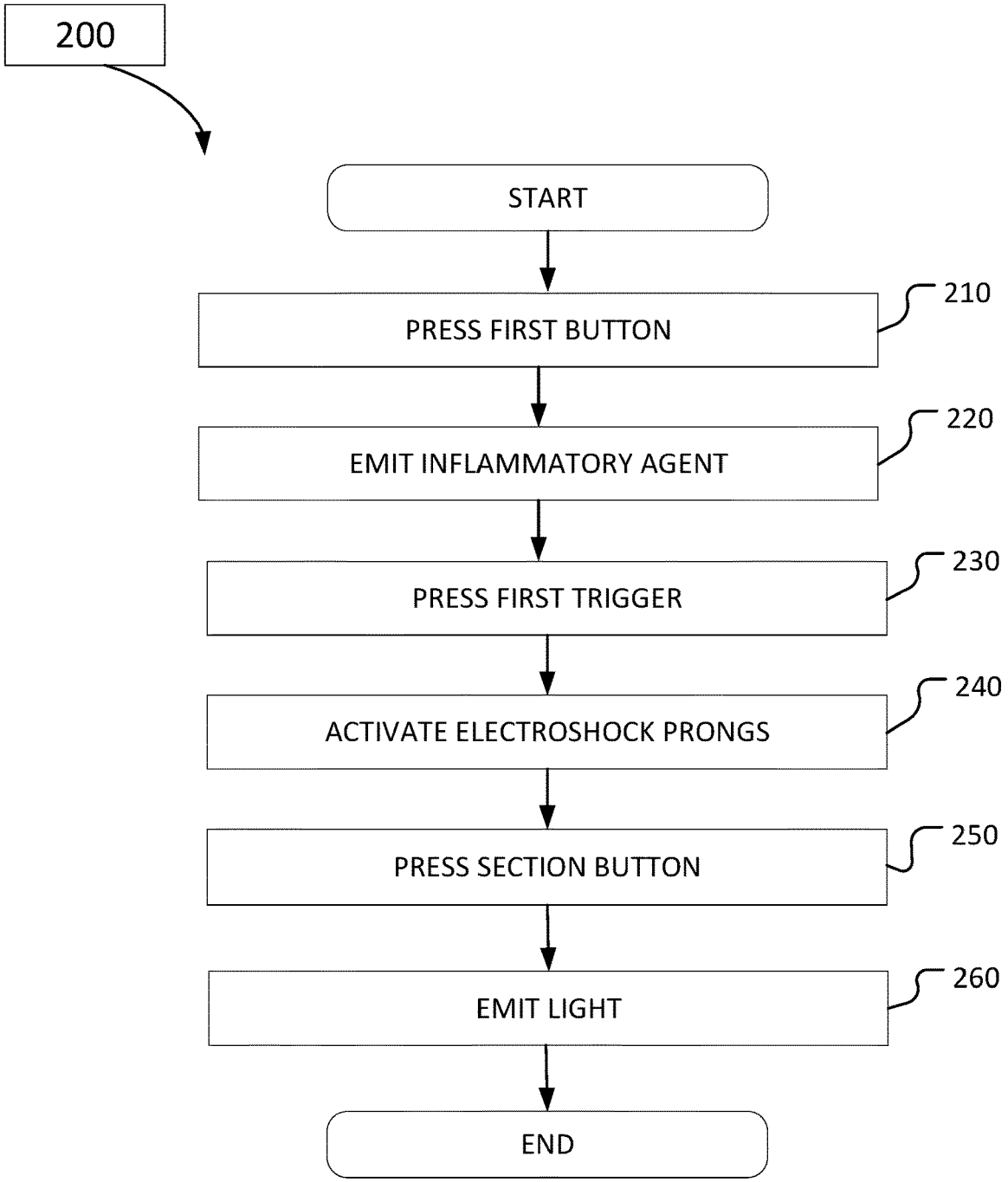
FIG. 2 depicts a method for utilizing a self-defense device, according to an embodiment.

FIG. 2 depicts an operation sequence for a self-defense device, according to an embodiment. The operational sequence presented below is intended to be illustrative. In some embodiments, operational sequence may be accomplished with one or more additional operations not described, and/or without one or more of the operations discussed. Additionally, the order in which the operations of operational sequence are illustrated in FIG. 2 and described below is not intended to be limiting.

At operation 210, a user may press a first button to activate an inflammatory agent. The button may be pressed by applying a force that is in parallel to a central axis of the self-defense device.

At operation 220, the inflammatory agent may be dispensed from a nozzle of the inflammatory agent towards the front surface of the self-defense device.

At operation 230, the user may press a trigger to activate electroshock prongs that are positioned on the front surface of the self defense device. The trigger may be pressed by applying a force that is orthogonal to the central axis of the self-defense device.

At operation 240, the electroshock prongs may apply electric current on a target.

At operation 250, the user may press a second button to activate lights on the front surface of the self defense device. The second button may be pressed by applying a force that is in parallel to the central axis of the self-defense device.

At operation 260, lights positioned on the front surface of the self-defense device may emit light in front of the self defense device.

Figure 3:
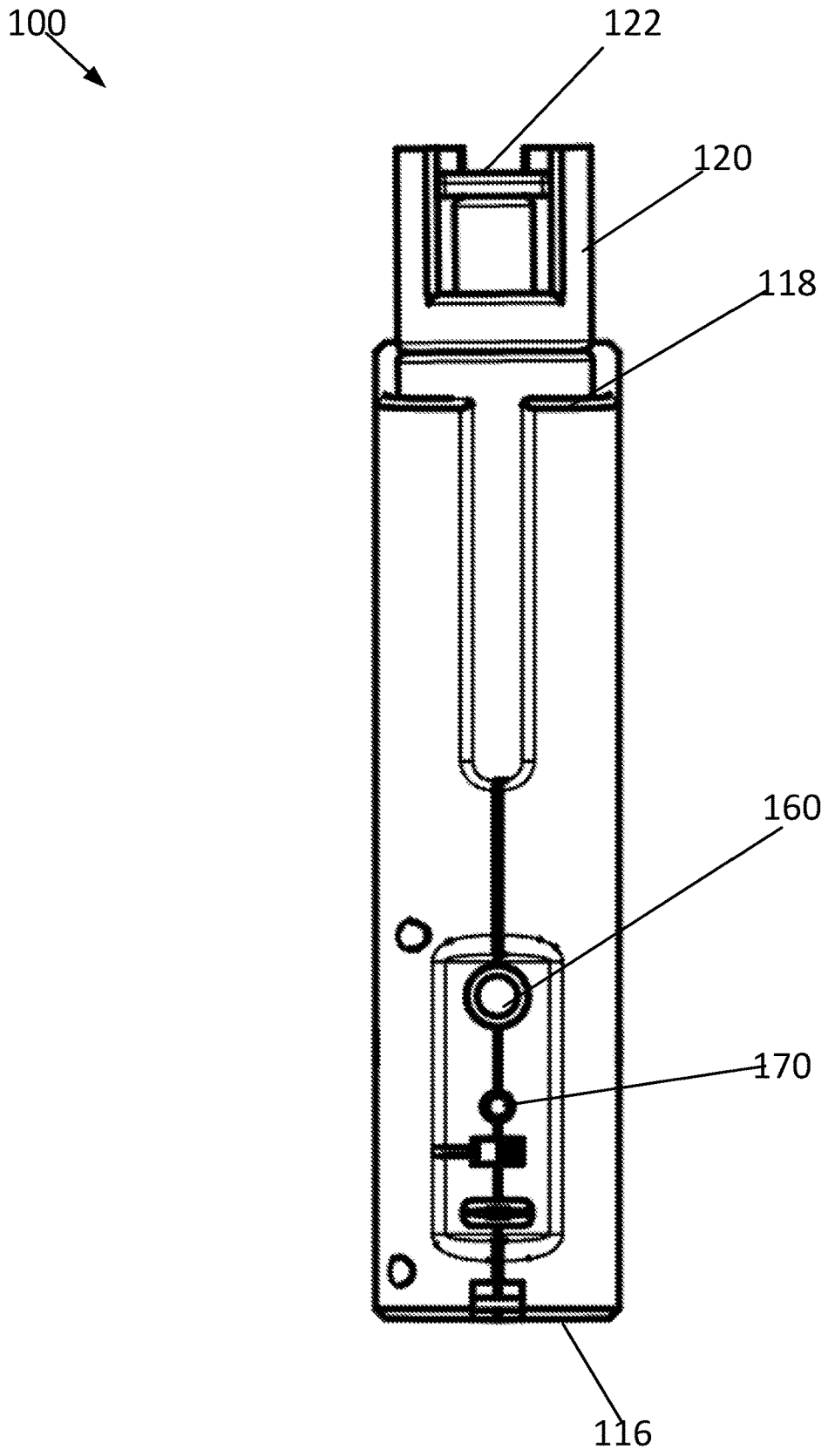
FIG. 3 depicts a rear view of a self-defense device, according to an embodiment.

FIG. 3 depicts a rear view of self-defense device 100, according to an embodiment.

Figure 4:
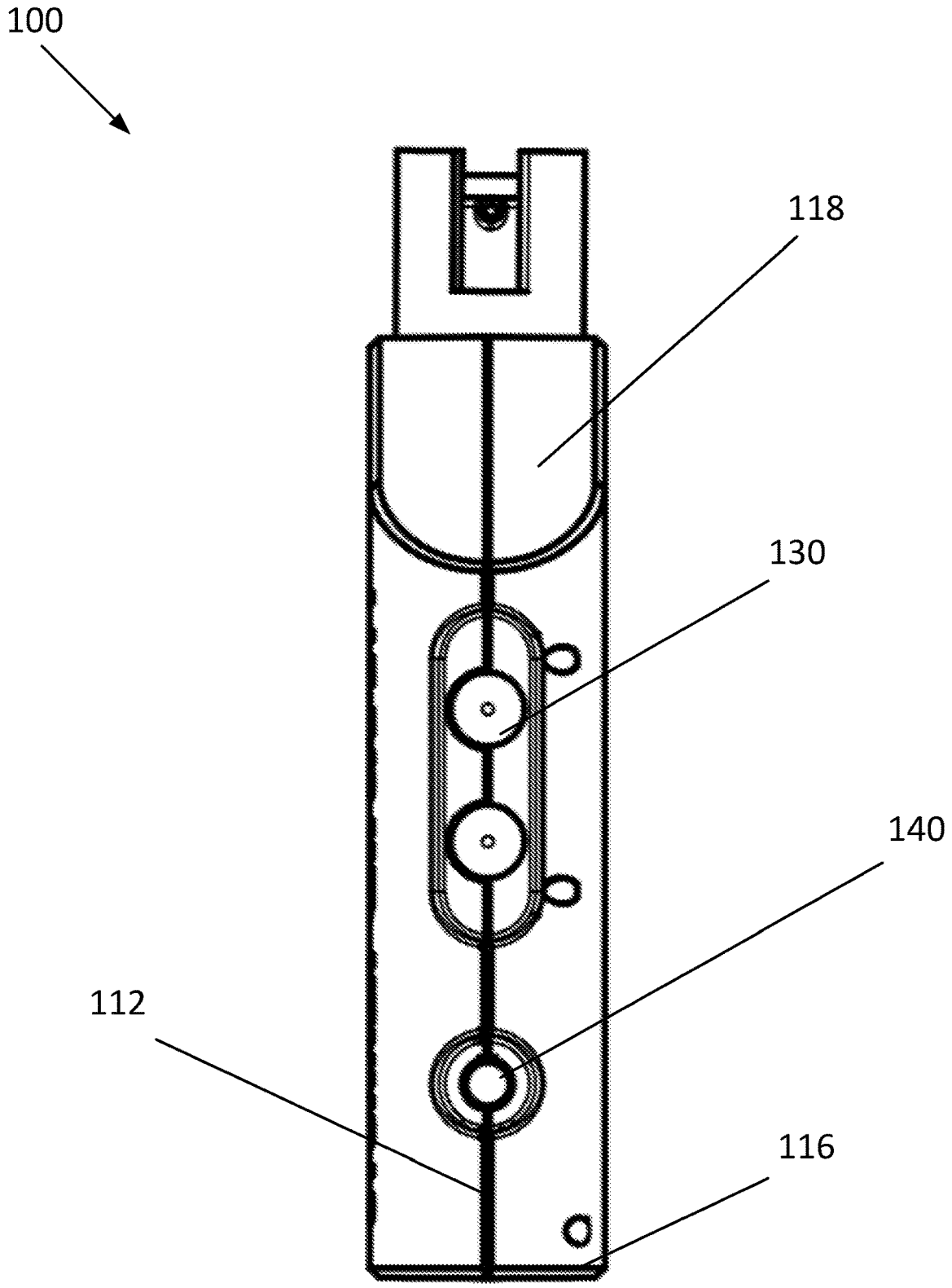
FIG. 4 depicts a front view of a self-defense device, according to an embodiment.

FIG. 4 depicts a front view of self-defense device 100, according to an embodiment.

Figure 5:
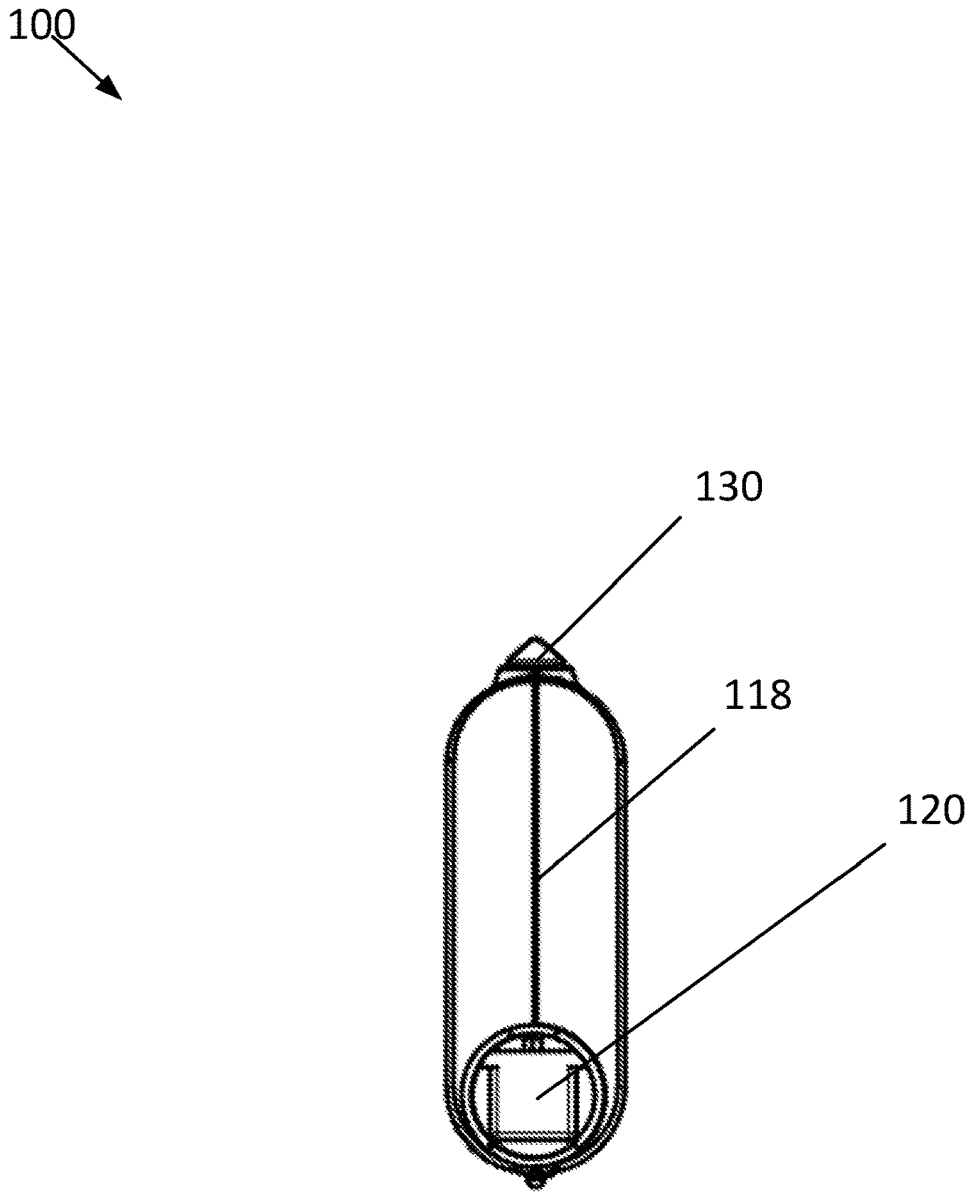
FIG. 5 depicts a top view of a self-defense device, according to an embodiment.

FIG. 5 depicts a top view of self-defense device 100, according to an embodiment.

Figure 6:
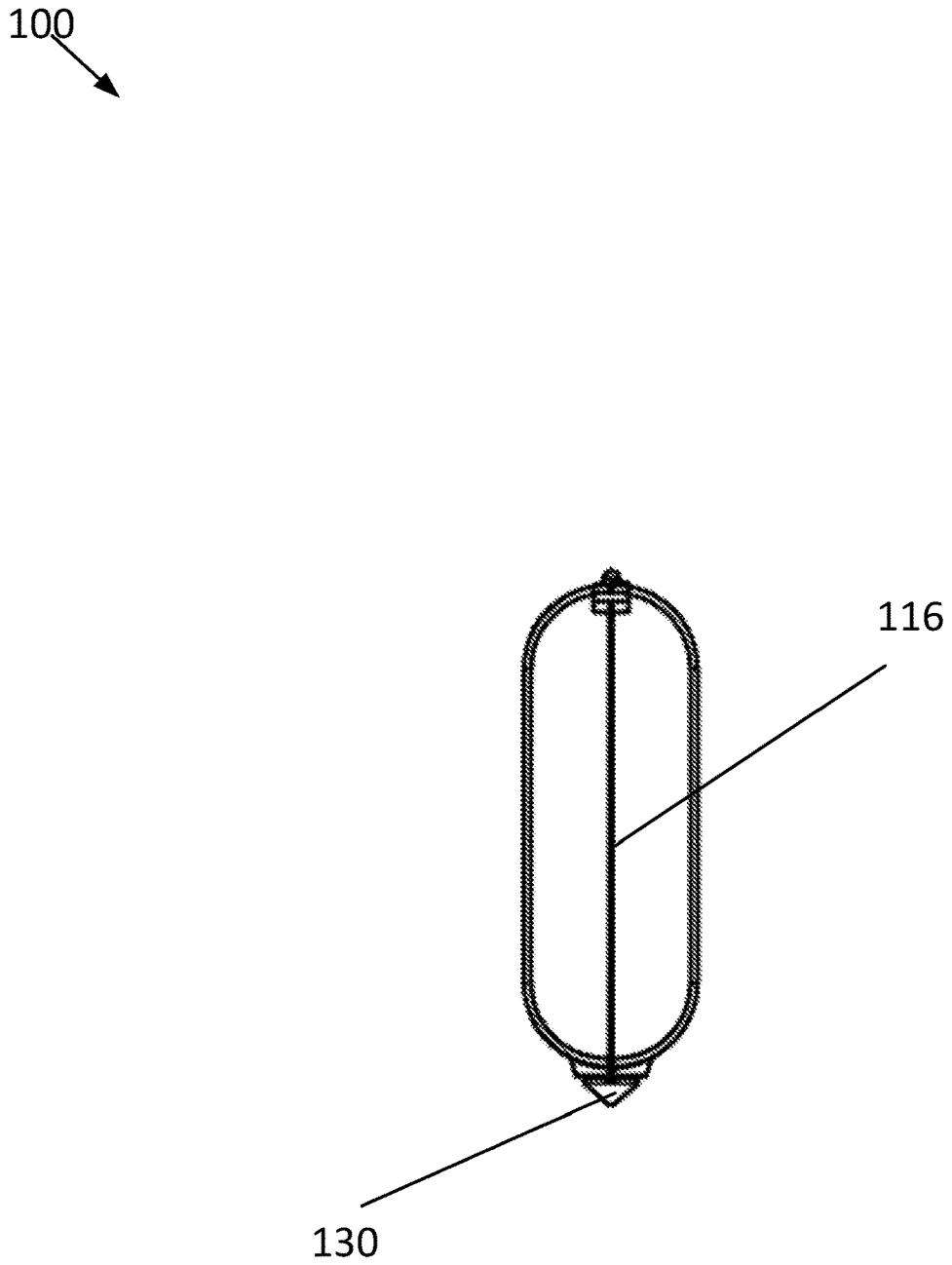
FIG. 6 depicts a bottom view of a self-defense device, according to an embodiment.

FIG. 6 depicts a bottom view of self-defense device 100, according to an embodiment.

Figure 7:
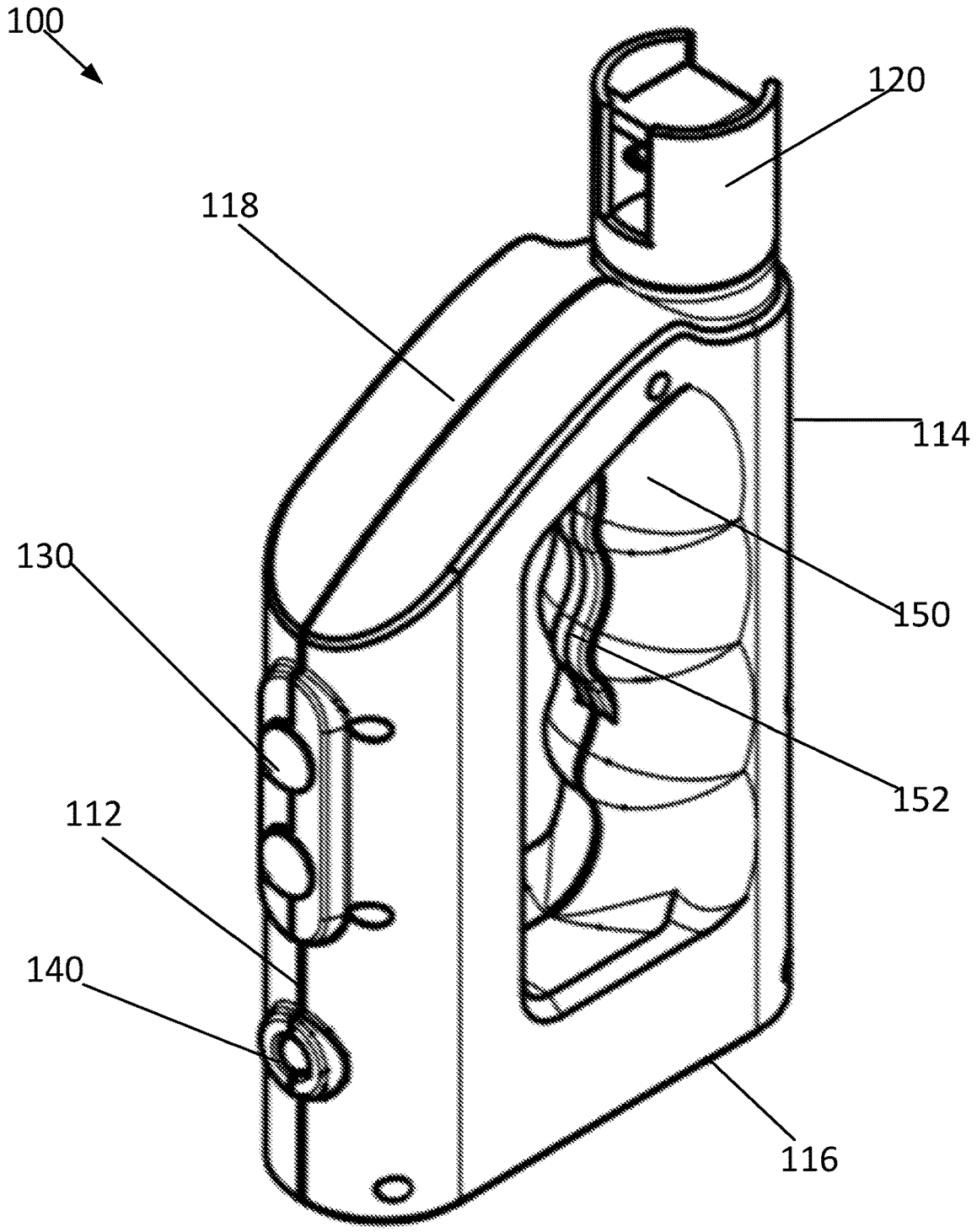
FIG. 7 depicts a perspective view of a self-defense device, according to an embodiment.

FIG. 7 depicts a perspective view of self-defense device 100, according to an embodiment.

Figure 8:
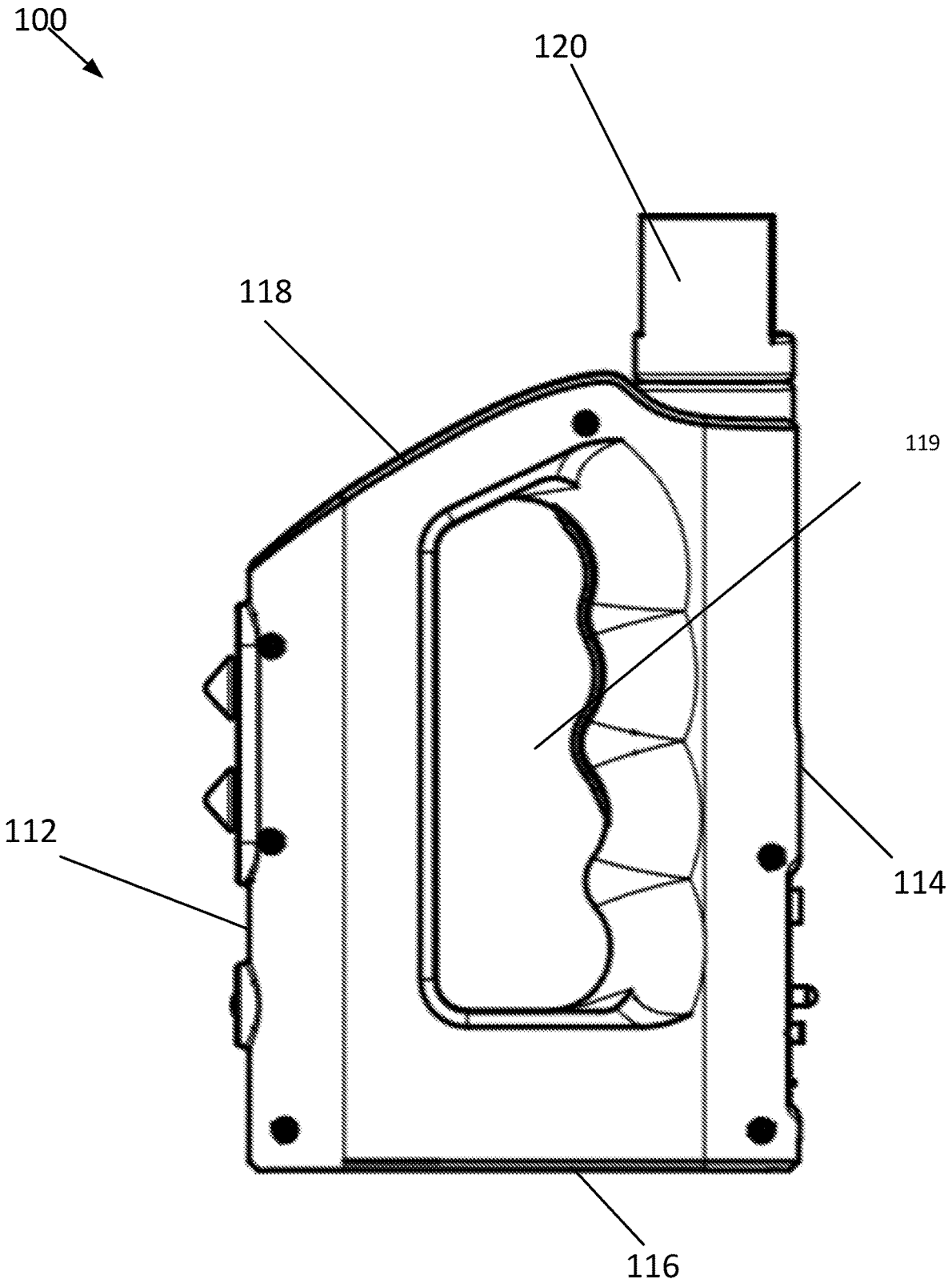
FIG. 8 depicts a second side view of a self-defense device, according to an embodiment Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

FIG. 8 depicts a second side view of a self-defense device, according to an embodiment Elements depicted in FIGS. 3-8 may be described above, and for the sake of brevity an additional description of these elements is omitted.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A self-defense device comprising:

a housing with a rear surface, upper surface, and front surface, a first height of the rear surface being longer than a second height of the front surface, the upper surface including a first portion and a second portion, wherein the second portion continually decreases a housing height;

an inflammatory agent with a nozzle positioned on the upper surface, the inflammatory agent being positioned more proximate to the rear surface than the front surface, wherein the inflammatory agent is activated via a first button receiving a first force in a first direction in parallel to a central axis of the self-defense device; and electroshock prongs positioned on the front surface, the electroshock prongs being activated via a first trigger receiving a second force in second direction, the first direction being orthogonal to the second direction.

2. The self-defense device of claim 1, wherein an angle of the second portion is a variable angle, wherein the variable angle increases closer to the front surface.

3. The self-defense device of claim 2, wherein the first portion includes an upward slope, and an apex of the upper surface is positioned between the first portion and the second portion.

4. The self-defense device of claim 3, wherein the nozzle of the inflammatory agent is positioned between the rear surface and the apex along a lateral axis of the self-defense device, and the nozzle is positioned vertically higher than the apex along a longitudinal axis of the self-defense device.

5. The self-defense device of claim 4, wherein a nozzle spray angle associated with the nozzle is based on the variable angle, wherein the nozzle spray angle is between twenty-five degrees and forty degrees.

6. The self-defense device of claim 1, wherein the housing includes an orifice, the first trigger being positioned within the orifice.

7. The self-defense device of claim 1, further comprising:

light emitting devices being positioned on the front surface, wherein the light emitting devices are activated via a second button receiving a third force in a third direction orthogonal to the central axis of the self-defense device.

8. The self-defense device of claim 7, wherein the third direction and the second direction are opposite directions.

9. The self-defense device of claim 8, wherein the second button is positioned on the rear surface.

10. The self-defense device of claim 9, where the first button, second button, and first trigger are positioned on different surfaces of the self-defense device.

11. The self-defense device of claim 10, wherein a first cross sectional area of the rear surface is larger than a second cross sectional area of the front surface.

12. The self-defense device of claim 7, wherein the first trigger is aligned with the electroshock prongs along a lateral axis of the self-defense device.

13. The self-defense device of claim 12, wherein the light emitting devices are misaligned with the lateral axis of the self-defense device.

14. The self-defense device of claim 1, wherein the housing is non-symmetrical along a lateral axis and a longitudinal axis.

* * * * *